United States Patent [19]

Toth

[11] 4,408,357

[45] Oct. 11, 1983

[54] DISPOSABLE GARMENT

[75] Inventor: Michael R. Toth, Andover, Mass.

[73] Assignee: The Kendall Company, Boston, Mass.

[21] Appl. No.: 344,428

[22] Filed: Feb. 1, 1982

[51] Int. Cl.[3] ..... A41B 9/00

[52] U.S. Cl. ..... 2/114; 2/DIG. 7

[58] Field of Search ..... 2/DIG. 7, 114, 93, 94

[56] References Cited

U.S. PATENT DOCUMENTS 3,803,640 4/1974 Ericson ..... 2/114

3,868,728 3/1975 Krzewinski ..... 2/114

*Primary Examiner*—Doris L. Troutman

*Attorney, Agent, or Firm*—Powell L. Sprunger

[57] ABSTRACT

A disposable garment comprising, a gown having a front panel, a pair of back panels extending from opposed sides of the front panel, and a pair of sleeves. The sleeves are constructed of a water repellent material having nonentangled fibers, and the back panels are constructed of a porous material having entangled fibers or a nonwoven material comprising a blend of nonentangled wood pulp and polyester fibers.

22 Claims, 2 Drawing Figures

DISPOSABLE GARMENT

BACKGROUND OF THE INVENTION

The present invention relates to disposable garments, and more particularly to surgical gowns.

In the past, a various assortment of gowns of the disposable type have been proposed for surgeons and nurses in an operating room. In general, the gowns have a front panel, a pair of back panels extending from opposed sides of the front panel, and a pair of sleeves. It has been found that different parts of the gown should provide different wearing characteristics, and thus should be constructed from different materials. For example, the sleeves should be constructed from a strong water repellent material to prevent tearing and passage of body fluids through the sleeves during the operation. On the other hand, at least part of the gown body portion, such as the back panels, should be constructed from a breathable material to provide ventilation to the wearer for comfort during the operation.

SUMMARY OF THE INVENTION

A principal feature of the present invention is the provision of an improved disposable garment of simplified construction.

The garment of the present invention comprises, a gown having a front panel, a pair of back panels extending from opposed sides of the front panel, and a pair of sleeves. The sleeves are constructed of a material having nonentangled fibers, and the back panels are constructed from a material having entangled fibers or a nonwoven material comprising a blend of nonentangled wood pulp and polyester fibers.

A feature of the present invention is that the sleeves are water repellent to minimize the possibility of passage of body fluids during an operation.

Yet another feature of the invention is that the sleeves are relatively strong to prevent tears in the sleeve during the operation.

Another feature of the invention is that the back panels are relatively breathable as compared to the sleeves in order to provide ventilation for the wearer during the operation.

A further feature of the invention is that the front panel may be constructed from the material of the back panels.

Still another feature of the invention is that the front panel may be constructed of the material of the sleeves.

Further features will become more fully apparent in the following description of the embodiments of this invention and from the appended claims.

DESCRIPTION OF THE PREFERRED EMBODIMENTS

Figure 1:
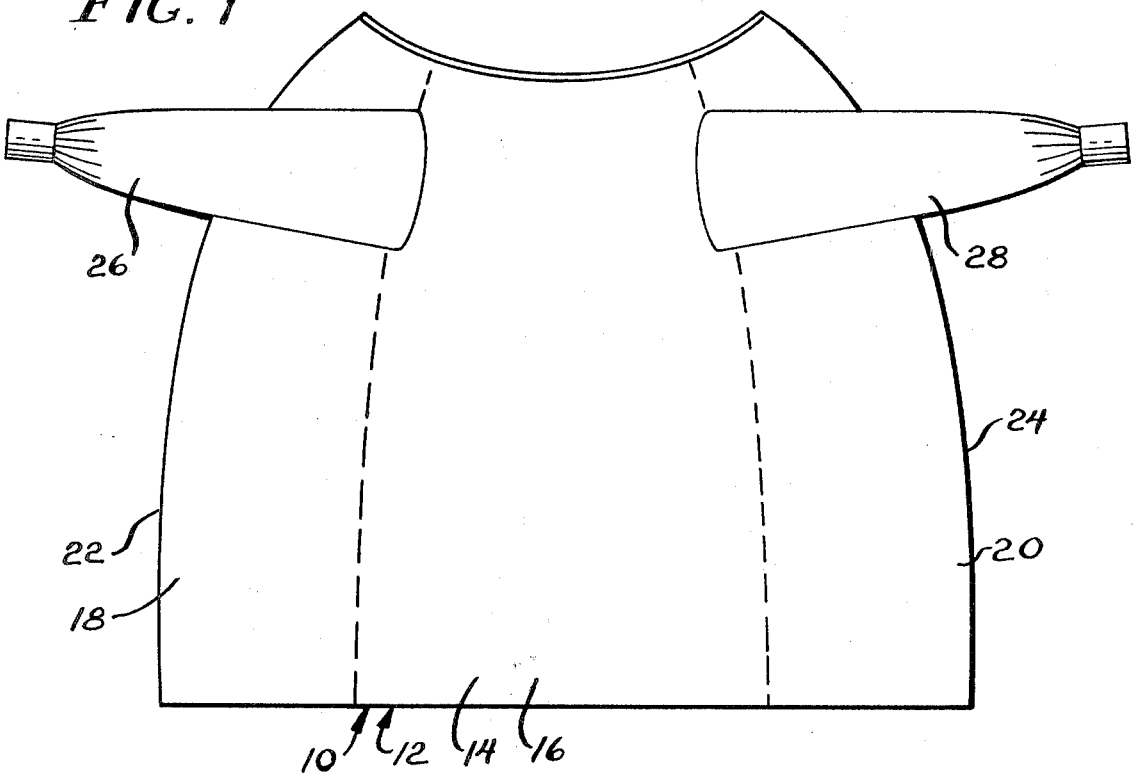
FIG. 1 is a plan view of a disposable garment of the present invention.

Referring now to FIG. 1, there is shown a disposable garment generally designated 10 comprising a surgical gown 12. The gown 12 comprises a body portion 14, which may be one-piece, having a front panel 16 for covering the front of the wearer, and a pair of back panels 18 and 20 extending from opposed sides of the front panel 16 for covering the back of the wearer. The back panels 18 and 20 have a pair of side edges 22 and 24, respectively, which define an opening on the back of the gown. The gown 12 has a pair of sleeves 26 and 28 secured to the body portion 14 of the gown for the arms of the wearer. In use, the back panels 18 and 20 overlap on the back of the wearer in order to close the back opening of the gown, and suitable belt means (not shown) is utilized to secure the back panels 18 and 20 in the overlapping relationship.

The sleeves 26 and 28 are constructed from a spun-bonded polyethylene of nonentangled fibers, such as Tyvek, a trademark of E. I. du Pont de Nemours. The material of spun-bonded polyethylene for the sleeves 26 and 28 is relatively strong to prevent tearing of the sleeves during use in an operation. Also, the material of the sleeves 26 and 28 is water repellent to minimize the possibility of passage of body fluids through the sleeves 26 and 28 during the operation.

In one form, the body portion 14 of the gown 12, including the front panel 16 and back panels 18 and 20, may be made from a hydroentangled fabric which is constructed by water pressure on the fibers to entangle the fibers, such as Sontara, a trademark of E. I. du Pont de Nemours. The hydroentangled fabric of the body portion 14 can be constructed from polyester fibers, a blend of rayon and polyester fibers, a blend of wood pulp and polyester fibers, a blend of wood pulp and rayon fibers, or a blend of wood pulp, polyester, and rayon fibers. The hydroentangled fabric of the body portion 14 is relatively porous and breathable to provide ventilation for the wearer during use of the gown. In an alternative form, the body portion 14 may be constructed from a nonentangled, wet-laid nonwoven material comprising a blend of wood pulp and polyester fibers, such as No. 3549, a trademark of The Dexter Corporation. In a preferred form, the nonwoven material of the body portion 14 may be treated for water repellency. The nonwoven material of the body portion 14 is more breathable than the fabric of the sleeves 26 and 28 to provide ventilation for the wearer during use of the gown.

Figure 2:
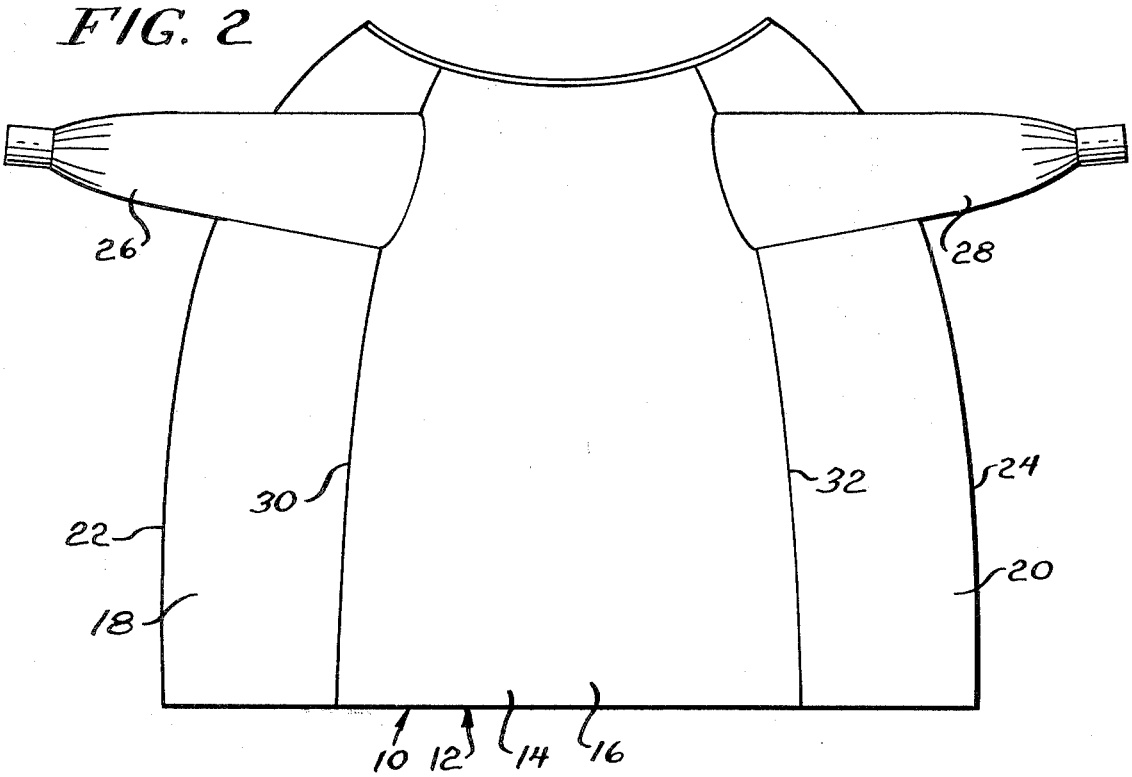
FIG. 2 is a plan view of another embodiment of the garment of the present invention.

Another embodiment of the present invention is illustrated in FIG. 2, in which like reference numerals designate like parts. In this embodiment, the front panel 16 is connected to the back panels 18 and 20 by suitable seams 30 and 32, respectively, such as by sewing, and the front panel 16 is constructed from a material different from the back panels 18 and 20. As before, the sleeves 26 and 28 are constructed from a nonentangled spun-bonded polyethylene, such as Tyvek. Also, in this embodiment, the front panel 16 is constructed from the same material as the sleeves 26 and 28, i.e., a nonentangled spun-bonded polyethylene, such as Tyvek. Thus, the front panel 16 is relatively strong to prevent tearing, and is water repellent to prevent passage of body fluids during the operation.

In this embodiment, the back panels 18 and 20 are constructed from the same material as the body portion 14 of FIG. 1, i.e., a hydroentangled fabric such as Sontara, or a nonentangled blend of wood pulp and polyester fibers, such as No. 3549 of The Dexter Corporation. Thus, the back panels are relatively breathable, as compared to the material of the sleeves 26 and 28, to provide ventilation in the gown for the wearer.

The foregoing detailed description is given for clearness of understanding only, and no unnecessary limitations should be understood therefrom, as modifications will be obvious to those skilled in the art.

I claim:

1. A disposable garment comprising, a gown having a front panel, a pair of back panels extending from opposed sides of the front panel, and a pair of sleeves, said sleeves being constructed of a water repellent material having nonentangled fibers, and said back panels being constructed of a porous material having entangled fibers.

2. The garment of claim 1 wherein said sleeves comprise a spun bonded polyethylene.

3. The garment of claim 1 wherein said front panel comprises a material having nonentangled fibers.

4. The garment of claim 3 wherein the front panel comprises a spun bonded polyethylene.

5. The garment of claim 1 wherein the back panels comprise a material having hydroentangled fibers.

6. The garment of claim 5 wherein the back panels comprise polyester fibers.

7. The garment of claim 5 wherein the back panels comprise a blend of rayon and polyester fibers.

8. The garment of claim 5 wherein the back panels comprise a blend of wood pulp and polyester fibers.

9. The garment of claim 5 wherein the back panels comprise a blend of wood pulp and rayon fibers.

10. The garment of claim 5 wherein the back panels comprise a blend of wood pulp, polyester, and rayon fibers.

11. The garment of claim 1 wherein the front panel is constructed of a material having entangled fibers.

12. The garment of claim 11 wherein the front panel comprises a material having hydroentangled fibers.

13. The garment of claim 12 wherein the front panel comprises polyester fibers.

14. The garment of claim 12 wherein the front panel comprises a blend of rayon and polyester fibers.

15. The garment of claim 12 wherein the front panel comprises a blend of wood pulp and polyester fibers.

16. The garment of claim 12 wherein the front panel comprises a blend of wood pulp and rayon fibers.

17. The garment of claim 12 wherein the front panel comprises a blend of wood pulp, polyester, and rayon fibers.

18. A disposable garment comprising, a gown having a front panel, a pair of back panels extending from opposed sides of the front panel, and a pair of sleeves, said sleeves being constructed from a water repellent material having nonentangled fibers, and said back panels being constructed from a nonwoven material comprising a blend of nonentangled wood pulp and polyester fibers.

19. The garment of claim 18 wherein the sleeves comprise a spun bonded polyethylene.

20. The garment of claim 18 wherein the front panel comprises a material having nonentangled fibers.

21. The garment of claim 20 wherein the front panel comprises a spun bonded polyethylene.

22. The garment of claim 20 wherein the front panel comprises a blend of wood pulp and polyester fibers.

* * * * *